US005672128A

United States Patent [19]

Conn

[11] Patent Number: 5,672,128

[45] Date of Patent: Sep. 30, 1997

[54] ELECTRONIC AUTOMATED GAME LINE

[75] Inventor: Byron C. Conn, Inman, S.C.

[73] Assignee: JAB Technologies, Inc., Inman, S.C.

[21] Appl. No.: 714,251

[22] Filed: Sep. 17, 1996

[51] Int. Cl.[6] ..... A63B 61/00

[52] U.S. Cl. ..... 473/467

[58] Field of Search ..... 473/467

[56] References Cited

U.S. PATENT DOCUMENTS

| | | | |
|---|---|---|---|
| 3,415,517 | 12/1968 | Krist | 473/467 |
| 3,982,759 | 9/1976 | Grant | 473/467 |
| 4,004,805 | 1/1977 | Chen et al. | 473/467 |
| 4,109,911 | 8/1978 | Van Auken | 473/467 |
| 4,365,805 | 12/1982 | Levine | 473/467 |
| 4,375,289 | 3/1983 | Schmall et al. | 473/467 X |
| 4,432,058 | 2/1984 | Supran | 473/467 |
| 4,664,376 | 5/1987 | Gray | 473/467 |
| 4,867,449 | 9/1989 | Carlton et al. | 473/467 |

*Primary Examiner*—William H. Grieb
*Attorney, Agent, or Firm*—Dallis Law Firm, P.A.

[57] ABSTRACT

An electronic switch device designed to detect surface contact along a boundary surface. The electronic switch device can be used as an electronic automated game line comprising a very thin game line mat divided between an in-bounds section and out-of-bounds section and further divided into a plurality of grided switches placed directly upon a playing surface such as a tennis court. The game line mat is sufficiently thin and having a top surface suitable for being painted over with the same paint cover used for a conventional playing surface. Surface contact is defined as being in-bounds or out-of-bounds with approximated contact location provided.

14 Claims, 4 Drawing Sheets

ELECTRONIC AUTOMATED GAME LINE

BACKGROUND OF THE INVENTION

1. Field of the Invention

The present invention relates to the field of electronic switch devices, more particularly, the invention is a very thin electronic switch device which may be adhered to the boundary area of a court allowing for the identification of "in-bounds" and "out-of-bounds" surface contact.

2. Description of the Related Art

Various athletic sporting games have predetermined boundaries beyond which a ball in play or even an athlete may not cross. Precise detection of out-of-bounds contact or line crossing is often made very difficult due to the speed which either the ball or athlete may be traveling. Examples of such commonly played sports that require such detection include tennis, basketball, volley ball, football and many others. Perhaps the most problematic sport requiring precise and accurate attention to out-of-bounds play is the game of tennis where the ball in play may be traveling at over 100 miles per hour as it makes contact with the playing surface. The human eye may not accurately detect contact of a tennis ball that may barely touch the very edge of a boundary line.

There have been many attempts at constructing devices that can more accurately detect the contact of a ball that falls on a boundary line or just outside a boundary line. These technologies include laser beam networks as well as devices that create a magnetic field around the boundary and detect interferences to that magnetic field. Examples of such technology include U.S. Pat. No. 4,664,376 to George S. Gray which relates to an electronic line fault detector having a plurality of electrical coils placed beneath a tennis court extending end to end adjacent a boundary line. When a ball comprising a metallic or ferromagnetic substance falls near a service line or tennis boundary the electronic system is designed to detect the proximity of the ball to the boundary.

U.S. Pat. No. 4,432,058 to Lyle D. Supran describes a complex network system for automatically making line-call decisions in tennis. This arbitration system operates as both detection device and score keeper. A plurality of electrical conductors are arranged on the surface of the playing field to determine the position of ball contact near a boundary line. A pressure sensitive tape is applied to the net to detect a "Let".

U.S. Patent No. 4,375,289 to Schmall et al. relates to an apparatus for monitoring a boundary line involving the formation of an electromagnetic field running along the surface of the boundary line. When the ball or other object breaks the magnetic field, a receiving conductor device registers the break in the field.

U.S. Pat. No. 4,004,805 to Kun-Mu Chen et al. relates to an electronic line monitoring system that uses laser beams and optical sensors to detect a ball traveling over or past a boundary line.

The existing prior art employ a variety of sometimes complicated technologies to detect when a ball has made contact with a line or makes contact just outside the line. The systems that use the creation of magnetic fields require that the playing ball be an electrically conductive ball. Such requirements make such a system complex and detailed to operate. The present invention makes use of touch sensitive technology in a novel way to obviate the complications identified in the prior art. Although the U.S. Patent to Supran discloses the use of pressure sensitive elements that can be "incorporated into the tennis court for example by the use of pressure sensitive rubber into carpet backing material", such existing touch sensitive technology would not work on a tennis court or similar playing field, because such a device must be rigorous and durable enough to withstand the heavy traffic and play as is encountered on a tennis court. The present invention is designed to be sufficiently thin and durable that it may be placed directly on top of the tennis playing surface and a number of inches beyond the boundary line and then painted over with the appropriate tennis court covering.

SUMMARY OF THE INVENTION

It is therefore an objective of this invention to provide an ultra thin electronic switch device for detecting surface contact and registering such surface contact.

It is further an objective of this invention to provide an effective means of detecting surface contact with a game line used in certain sporting events such as tennis, basketball, volleyball, etc.

It is still further an objective of this invention to provide a means for precisely detecting the difference between contact that is "on the line" and contact that is just outside the line.

It is yet further an objective of this invention to provide an electronic switch technology made from flexible printed circuit material that will result in a very thin electronic switch.

It is yet another objective of this invention to provide an electronic automated game line detection that can distinguish between surface contact of a rapidly moving ball and the contact of a body part such as a foot or leg.

It is still yet another objective of this invention to provide a means for detecting the approximate location of contact either on a game line or just outside a game line.

These as well as other objectives are accomplished by an electronic switch device comprising a very thin switching device having a thin insulating strip with a plurality of contact holes sandwiched between a top and bottom layer having a very thin conductive material adhered onto a non-conductive backing. The contact signal is carried by means of a plurality of micro thin traces running lengthwise along the bottom side of the bottom layer non-conductive backing. The total thickness of the switch is designed to be between 0.005 and 0.030 inches. The invention may be used in a number of applications requiring touch sensitive detection outside of the field of sports including keyboards, keypads and other devices that require touch or depression engagement.

In reference to sporting applications the present invention allows for facile application to a sports boundary such as tennis court fault lines and out-of-bounds lines using an adhesive to glue the switch mat to the court and simply paint over the switch mat as one would paint over the remainder of the tennis court. The extreme edges of the switch mat are finely bevelled so as to blend with the existing court surface.

One embodiment of the invention has the bottom layer conductive side divided between an in-bounds contact section and an out-of-bounds contact section that extends a number of inches beyond the boundary line. The importance of integrating an in-bounds contact section with an out-of-bounds contact section is to insure that ball contact will be called "in" so long as some contact is made on the line, whether or not the ball contact occurs mostly within the out-of-bounds section.

The preferred embodiment includes a grided bottom layer conductive side which will allow for identifying the approximate location of ball contact. In this fashion the bottom layer conductive side is broken into a plurality of grids, each grid being separately connected to a dedicated electrical trace. Contact with an individual grid will identify the contact location of ball in play.

BRIEF DESCRIPTION OF THE DRAWINGS

A preferred embodiment of the present invention is described herein with reference to the drawings wherein.

DETAILED DESCRIPTION OF THE PREFERRED EMBODIMENT

Figure 1:
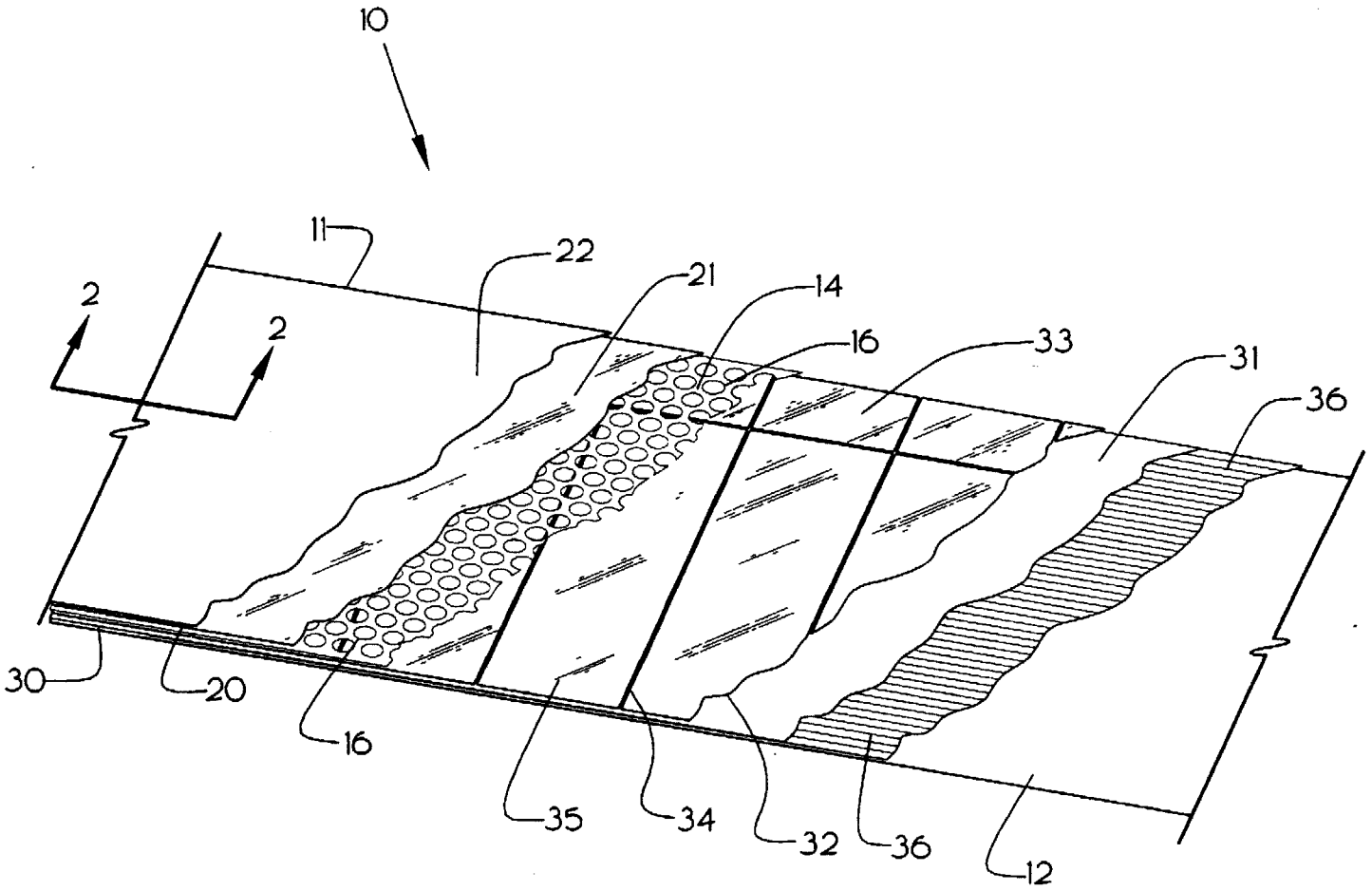
FIG. 1 of the drawings is a perspective view of the apparatus showing a cut-away view which reveals the various layers of the electronic automated game line mat.
Figure 2:
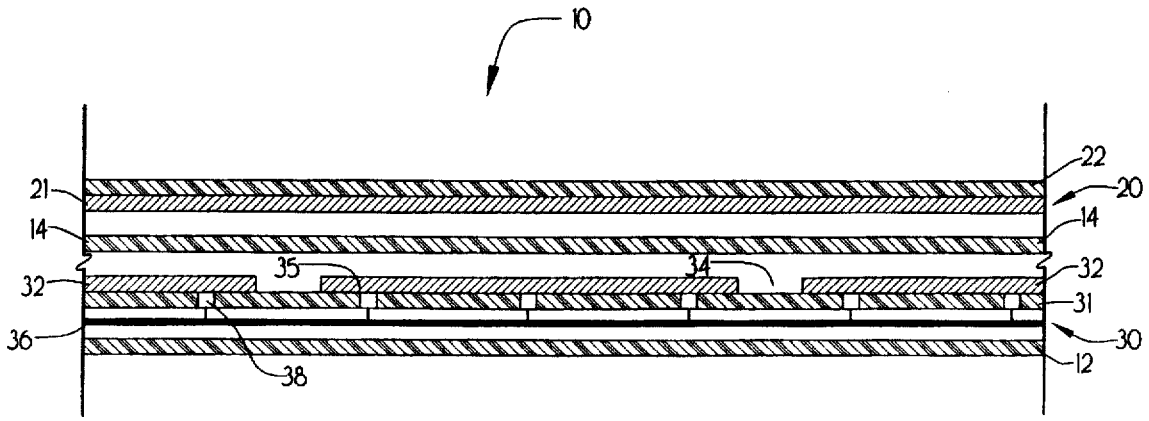
FIG. 2 of the drawings is a cross sectional view of the electronic automated game line mat in a blow-up presentation to illustrate the essential layers of the mat.
Figure 3:
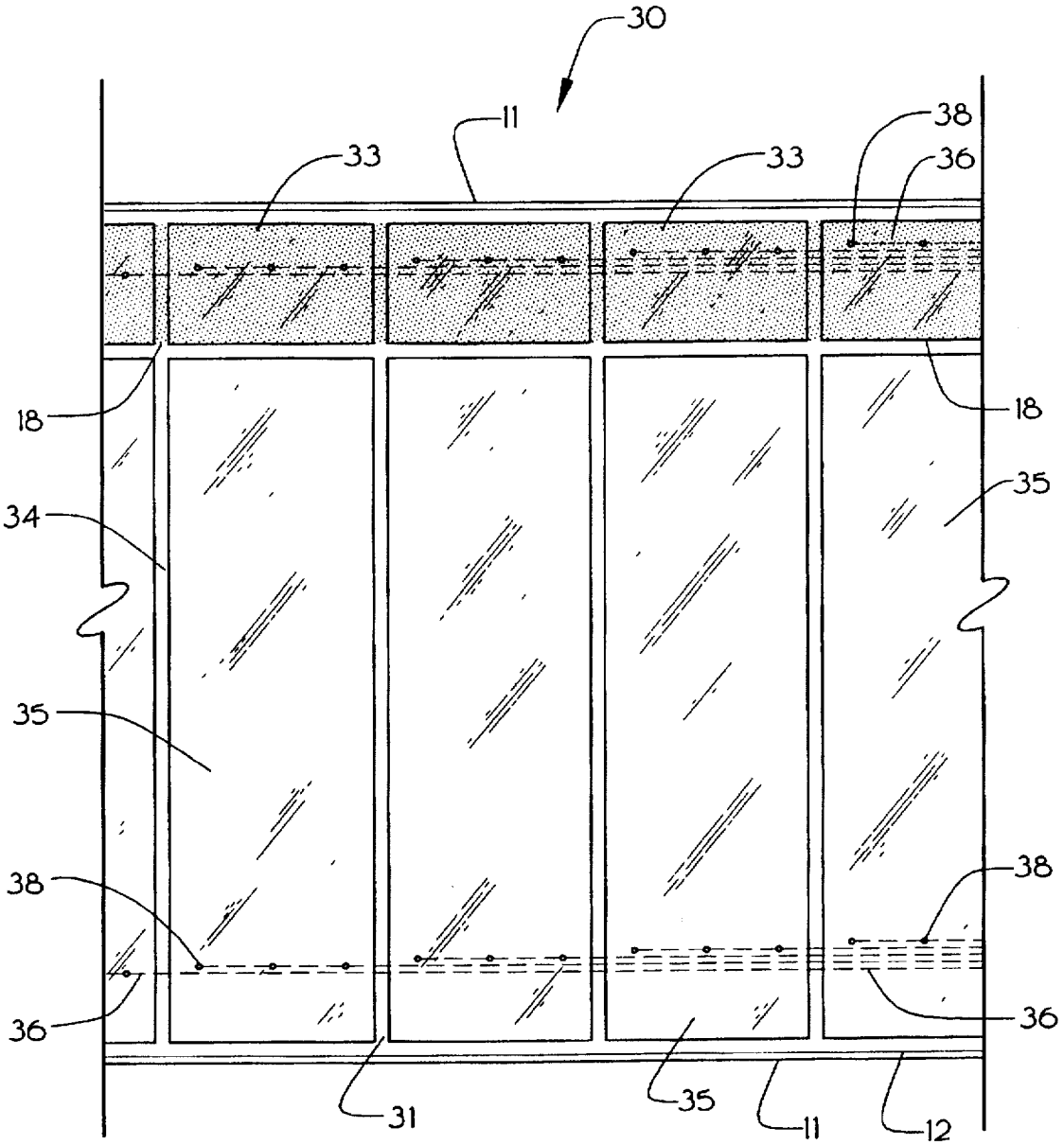
FIG. 3 of the drawings is a plan view revealing the bottom layer of the electronic automated game line mat showing the in-bounds and out-of-bounds grids with a phantom view of the tennis boundary line running over the in-bounds grids.

Referring to the drawings by numerals of reference, there is shown in FIGS. 1, 2 and 3 the electronic automated game line mat (10). The basic components of the game line mat (10) include an insulating layer (14) sandwiched between a top layer (20) having a top layer conductive side (21) and a bottom layer (30) having a bottom layer conductive side (32) divided into in-bounds grids (33) and out-of-bounds grids (35).

Referring to FIG. 1, a prospective view of the electronic automated game line mat (10) is shown with respective cut-away views of each of the essential layers of the game line mat (10). The top layer (20) comprises a top layer non-conductive backing (22) and a top layer conductive side (21). The top layer conductive side (21) faces down toward the insulating layer (14). The insulating layer (14) is made from a thin non-conductive material having a plurality of contact holes (16). The purpose of the plurality of contact holes (16) is to provide contact between the top layer conductive side (21) with the bottom layer conductive side (32) when there is surface impact upon the game line mat (10). The bottom layer (30) of the game line mat (10) comprises a bottom layer non-conductive backing (31) to which a bottom layer conductive side (32) is adhered.

Continuing with reference to FIG. 1, a plurality of conductive traces (36) are secured to the underside of the bottom layer non-conductive backing (31). These conductive traces (36) are individually connected to the bottom layer conductive side (32). When contact is made between the top layer conductive side (21) and the bottom layer conductive side (32) the conductive traces (36) register such contact by a signaling means to a microprocessor. The plurality of traces (36) are protected from the elements by a thin bottom protective layer (12).

The preferred embodiment of the game line mat (10) comprises a bottom layer conductive side (32) that is segmented into various grids. FIG. 1 shows a bottom layer conductive side (32) divided among in-bounds grids (33) and out-of-bounds grids (35). Both in-bounds (33) and out-of-bounds (35) grids are separated by a narrow grid spacing (34). Each individual grid has at least one dedicated conductive trace (36) attached connected to said grid through a perforation in the bottom layer non-conductive backing (31). When surface contact is made with a singular grid, the location of such grid may be identified by identifying the dedicated trace connected to such grid.

The entire game line mat (10) is designed to be between 0.010 and 0.020 inches thick so that the game line mat (10) can be adhesively secured to the concrete playing surface of a tennis court or similar playing surface and simply painted over with the appropriate playing surface materials. The leading edges (11) of the game line mat (10) are finely beveled so as to integrate well onto the standard playing surface.

Referring to FIG. 2, a cross sectional view of the game line mat (10) is shown. This cross sectional view is presented as a blow-up depiction of the game line mat (10) for the purpose of clearly revealing the interrelated layers of the game line mat (10). The top layer (20) comprising the top layer non-conductive side (22) and top layer conductive side (21) is laid over the insulating layer (14). The bottom layer (30) has a bottom layer conductive side (32) facing the insulting layer (14). The bottom layer conductive side (32) is adhered to the bottom layer non-conductive backing (31). FIG. 2 also shows the plurality of conductive traces (36) running lengthwise along the game line mat (10). For purpose of clarity, these conductive traces (36) are not shown actually adhered to the back side of the bottom layer non-conductive backing (31), but they are in fact adhered to the bottom layer non-conductive backing (31). Finally, the game line mat has a thin, synthetic bottom protective layer (12) designed to protect the conductive traces from the elements.

Still referring to FIG. 2, the trace perforations (38) are clearly indicated. The purpose of the trace perforations (38) is to provide a contact conduit between the plurality of conductive traces (36) and the grids of the bottom layer conductive side (32).

Referring to FIG. 3, a plan view of the bottom layer (30) of the game line mat (10) is depicted to reveal the in-bounds grids (33) and out-of-bounds grids (35). The tennis boundary line (18) is shown superimposed over the in-bounds grids (33). A representative number of conductive traces (36) is shown connecting individually to each grid by means of a plurality of trace perforations (38). When surface contact is made over the tennis boundary line (18), said contact is registered by at least one in-bounds grid (33). An electrical signal is carried to a microprocessor by at least one dedicated conductive trace (36) that is connected to said in-bounds grid (33) through at least one trace perforation (38) that pierces through the bottom layer non-conductive backing (31).

Still referring to FIG. 3, the grid spacing (34) between the in-bounds grids (33) and the out-of-bounds grids (35) is small enough that a tennis ball that makes most of its contact outside the tennis boundary line (18), but still has some contact on the tennis boundary line (18) will be registered as being "in". The accuracy of identifying such actual contact just "on the line" would be difficult to verify by human observation alone. The out-of-bounds grids (35) extend a number of inches beyond the tennis boundary line (18) to verify out-of-bounds contact. Each individual grid corresponds to a predetermined location on the playing court so that the relative location of contact over the game line mat (10) as shown in FIG. 1 may be made.

Figure 4:
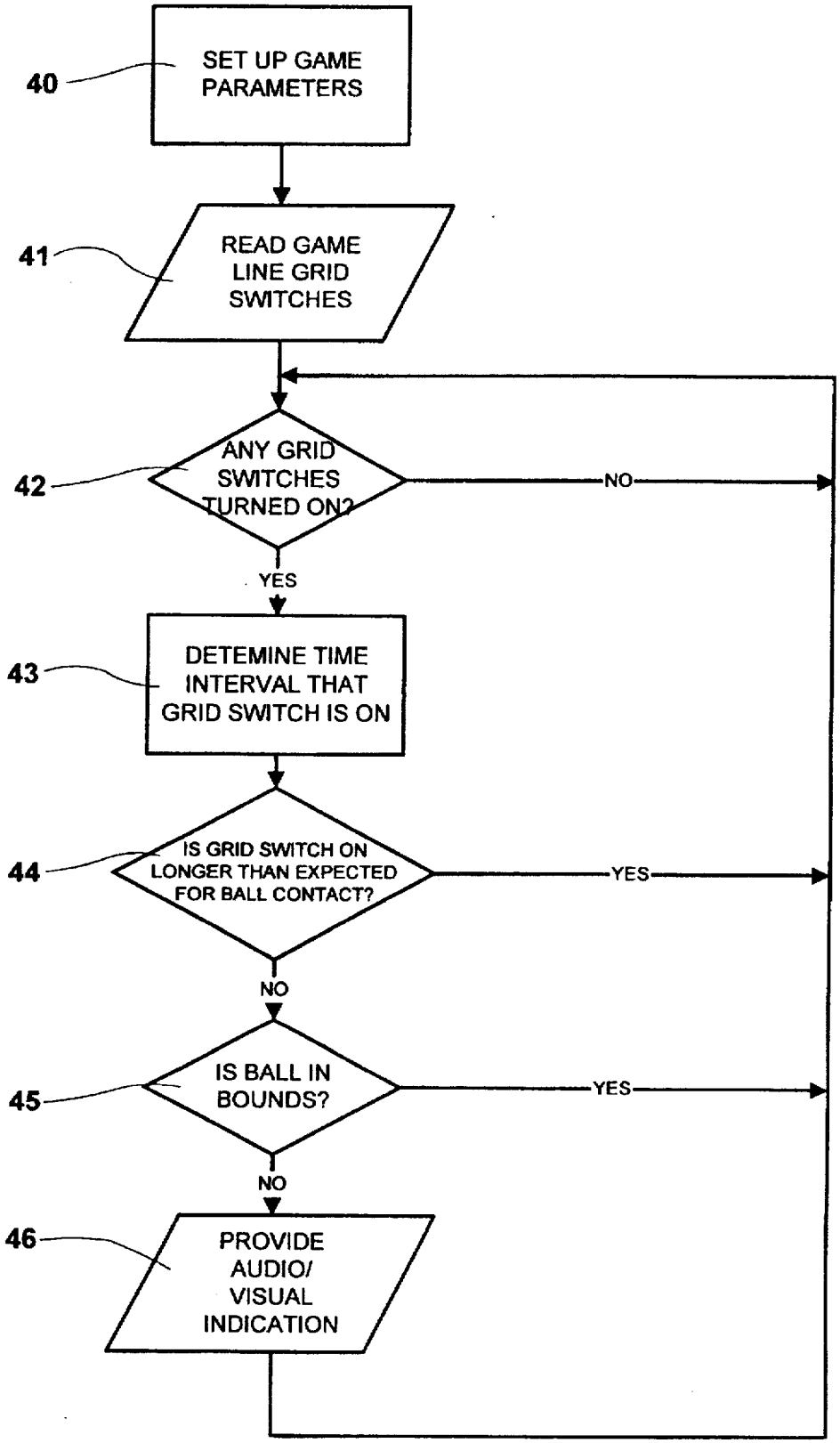
FIG. 4 of the drawings is a flow chart depicting the operation of the electronic automated game line illustrating the parameters and protocol used during the operation of the invention.

Referring to FIG. 4, a simple flow chart diagram is provided depicting the operation of the electronic automated game line during a typical sporting event. The set up game parameters (40) box is the starting point for the operation of the invention. A microprocessor is electronically connected to the system through the plurality of conductive traces (36) as shown in FIG. 1. The microprocessor reads the game line grid switches (41) to determine if and when a grid switch is turned on (42). If no grid switch is turned on, the system continues to read the game line switches (41). When contact is made with the surface of the game line mat (10) as shown in FIG. 1, an in-bounds grid (33) or out-of-bounds grid (35) will switch on. After switching on, a determination is made of the time interval that the grid switch is on (43). This determination is necessary in order to distinguish between the very short contact time made by a bouncing ball as compared to the longer contact made by a stepping foot or other body contact with the game line mat (10) as shown in FIG. 1. If it is determined that the grid switch is on for an interval of time longer than that expected for ball contact (44) (meaning there was foot contact), the system returns to reading the game line grid switches (41), unless it is desired to determine a foot fault.

Continuing with reference to FIG. 4, if the contact time interval is determined to be that expected for a bouncing ball, the associated microprocessor determines if the ball is in-bounds (45). If the ball contact is determined to be an in-bounds contact, the system returns to reading the game line grid switches (41). If, however, one of the out-of-bounds grids (35), as shown in FIG. 1, is switched on, and an audio/visual indication (46) of the surface contact is provided. After providing such audio/visual indication (46), the system returns to reading game line grid switches (41).

A preferred embodiment of the present invention is described herein. It is to be understood, of course, that changes and modifications may be made in the embodiment without departing from the true scope and spirit of the present invention as defined by the appended claims.

That which is claimed is:

1. An electronic switch device for detecting physical contact with a surface, comprising in combination:

a. a top layer having a top layer conductive side;

b. a bottom layer having a bottom layer non-conductive backing with a bottom layer conductive side adhered to said bottom layer non-conductive backing;

c. an insulating layer sandwiched between said top layer and bottom layer so that said top layer conductive side faces said bottom layer conductive side, said insulating layer having a plurality of contact holes through which said top layer conductive side makes contact with said bottom layer conductive side when sufficient force is applied to said top layer;

d. at least one conductive trace adhered to said bottom layer non-conductive backing of said bottom layer opposite said bottom layer conductive side;

e. a bottom protective layer adhered to and protecting said conductive trace;

f. a means for electrically connecting said conductive trace to said bottom layer conductive side; and g. a means for receiving an electrical signal from said conductive trace when said top layer conductive side makes contact with said bottom layer conductive side through said plurality of contact holes of said insulating layer.

2. The electronic switch device for detecting physical contact with a surface according to claim 1 wherein said means for connecting said conductive traces to said bottom layer conductive side comprises a least one trace perforation piercing through said trace and said bottom layer non-conductive backing through said bottom layer conductive side.

3. The electronic switch device for detecting physical contact with a surface according to claim 2 wherein said top layer non-conductive backing and said bottom layer non-conductive backing are made of a thin, flexible and durable substrate material ranging in thickness between 0.0005 and 0.005 inches.

4. The electronic switch device for detecting physical contact with a surface according to claim 3 wherein said thin, flexible and durable plastic is "KAPTON".

5. The electronic switch device for detecting physical contact with a surface according to claim 2 wherein said top layer, said insulating layer, said bottom layer together with said bottom protective layer comprises a combined cross sectional thickness between 0.005 and 0.030 inches.

6. An electronic automated game line for detecting physical contact with a playing surface, comprising in combination:

a. a top layer having a top layer conductive side;

b. a bottom layer having a bottom layer non-conductive backing with a bottom layer conductive side adhered to said bottom layer non-conductive backing;

c. said bottom layer conductive side being divided into an in-bounds section and out-of-bounds section;

d. an insulating layer sandwiched between said top layer and bottom layer so that said top layer conductive side faces said bottom layer conductive side, said insulating layer having a plurality of contact holes through which said top layer conductive side makes contact with said bottom layer conductive side when sufficient force is applied to said top layer;

e. a plurality of conductive traces adhered to said bottom layer non-conductive backing of said bottom layer opposite said bottom layer conductive side;

f. a bottom protective layer adhered to and protecting said plurality of conductive traces;

g. a means for electrically connecting said plurality of conductive traces to said bottom layer conductive side; and h. a means for receiving an electrical signal from said plurality of traces when said top layer conductive side makes contact with said bottom layer conductive side through said plurality of contact holes of said insulating layer.

7. The electronic automated game line for detecting physical contact with a playing surface according to claim 6 wherein said means for connecting said plurality of conductive traces to said bottom layer conductive side comprises at least one trace perforation piercing through said trace and said bottom layer non-conductive backing through said bottom layer conductive side.

8. The electronic automated game line for detecting physical contact with a playing surface according to claim 7 wherein said top layer further comprises a top layer non-conductive backing to which said top layer conductive side is adhered.

9. The electronic automated game line for detecting physical contact with a playing surface according to claim 8 wherein said top layer non-conductive backing and said bottom layer non-conductive backing are made of a thin, flexible and durable substrate material ranging in thickness between 0.0005 and 0.005 inches.

10. The electronic automated game line for detecting physical contact with a playing surface according to claim 9 wherein said thin, flexible and durable plastic is "KAPTON".

11. The electronic automated game line for detecting physical contact with a playing surface according to claim 8 wherein said top layer, said insulating layer, said bottom layer together with said bottom protective layer comprises a combined cross sectional thickness between 0.005 and 0.030 inches.

12. The electronic automated game line for detecting physical contact with a playing surface according to claim 8 wherein said in-bounds section and said out-of-bounds section of said bottom layer conductive side is further divided into a plurality of in-bounds grids and out-of-bounds grids, respectively.

13. An electronic automated game line for detecting physical contact with a playing surface according to claim 12 wherein said means for receiving said electrical signal from said plurality of traces is capable of determining a time interval of said electrical signal.

14. An electronic automated game line for detecting physical contact with a playing surface according to claim 12 further comprising at least one connection means to each said in-bounds grids and said out-of-bounds grids.

* * * * *